US008839590B1

(12) United States Patent
Kortman

(10) Patent No.: US 8,839,590 B1
(45) Date of Patent: Sep. 23, 2014

(54) ACOUSTICAL GRID AND METHOD OF USE

(71) Applicant: FF Walls, LLC, Holland, MI (US)

(72) Inventor: Calvin Jay Kortman, Holland, MI (US)

(73) Assignee: FF Walls, LLC, Holland, MI (US)

( * ) Notice: Subject to any disclaimer, the term of this patent is extended or adjusted under 35 U.S.C. 154(b) by 0 days.

(21) Appl. No.: 13/930,835

(22) Filed: Jun. 28, 2013

Related U.S. Application Data

(60) Provisional application No. 61/665,459, filed on Jun. 28, 2012.

(51) Int. Cl.
*E04G 23/00* (2006.01)
*E04B 9/34* (2006.01)

(52) U.S. Cl.
CPC ..... *E04B 9/34* (2013.01)
USPC ..... 52/741.4; 52/144; 52/664; 160/136; 160/232

(58) Field of Classification Search
USPC ..... 52/144, 645, 664, 668, 741.4; 160/136, 160/137, 164, 152, 232, 234; 362/317, 319, 362/325, 354
See application file for complete search history.

(56) References Cited

U.S. PATENT DOCUMENTS

| | | | | | |
|---|---|---|---|---|---|
| 145,137 | A | * | 12/1873 | Wade | 217/23 |
| 2,837,632 | A | * | 6/1958 | Lipscomb | 362/342 |
| 2,939,543 | A | * | 6/1960 | Zingone | 52/145 |
| 3,024,355 | A | * | 3/1962 | Lipscomb | 362/342 |
| 3,050,162 | A | * | 8/1962 | Zingone | 52/666 |
| 3,083,761 | A | * | 4/1963 | Attwood | 160/136 |
| 3,351,154 | A | * | 11/1967 | Kodaras | 181/292 |
| 3,378,980 | A | * | 4/1968 | Blitzer, Jr. | 52/668 |
| 3,380,206 | A | * | 4/1968 | Barnett | 52/145 |
| 3,669,820 | A | * | 6/1972 | Fredericks | 428/116 |
| 3,798,446 | A | * | 3/1974 | Deaton | 362/451 |
| 3,892,898 | A | * | 7/1975 | Yasui | 428/116 |
| 3,969,870 | A | * | 7/1976 | Deaton | 52/645 |
| 4,001,964 | A | * | 1/1977 | Hooker | 446/488 |
| 4,388,354 | A | * | 6/1983 | Suominen | 428/12 |
| 4,450,027 | A | * | 5/1984 | Colson | 156/193 |
| 4,471,596 | A | * | 9/1984 | Deaton et al. | 52/668 |
| 4,865,889 | A | * | 9/1989 | Boyse | 428/12 |
| 4,984,617 | A | * | 1/1991 | Corey | 160/84.02 |
| 5,558,925 | A | * | 9/1996 | Fritzman | 428/181 |
| 5,701,939 | A | * | 12/1997 | Pinto et al. | 160/84.01 |
| 6,103,336 | A | * | 8/2000 | Swiszcz | 428/116 |
| 6,192,642 | B1 | * | 2/2001 | Colson et al. | 52/506.06 |
| 6,199,337 | B1 | * | 3/2001 | Colson et al. | 52/506.06 |
| 6,319,586 | B1 | * | 11/2001 | Colson | 428/116 |
| 6,427,409 | B2 | * | 8/2002 | Colson et al. | 52/506.08 |
| 6,601,928 | B1 | * | 8/2003 | Kortman et al. | 312/3 |

(Continued)

FOREIGN PATENT DOCUMENTS

| | | | |
|---|---|---|---|
| CN | 101554787 | A | 10/2009 |
| CN | 102261139 | A | 4/2011 |

(Continued)

*Primary Examiner* — William Gilbert
*Assistant Examiner* — James Ference
(74) *Attorney, Agent, or Firm* — McGarry Bair PC

(57) ABSTRACT

A method for dampening acoustical vibration within a room including providing a grid formed of a plurality of cells defined by panels made from a flexible or deformable material which do not intersect one another such that the grid can be collapsed and expanded in a parallelogram motion. The grid can be positioned above floor level to attenuate acoustical sound within the room.

8 Claims, 5 Drawing Sheets

(56) References Cited

U.S. PATENT DOCUMENTS

| | | | | |
|---|---|---|---|---|
| 6,630,222 | B1 * | 10/2003 | Fay et al. | 428/118 |
| 7,051,489 | B1 * | 5/2006 | Swiszcz et al. | 52/783.18 |
| 7,194,846 | B2 * | 3/2007 | Swiszcz et al. | 52/793.11 |
| 7,198,388 | B2 * | 4/2007 | Pilby | 362/325 |
| 7,377,084 | B2 * | 5/2008 | Swiszcz et al. | 52/793.11 |
| 7,686,060 | B2 * | 3/2010 | Anthony | 160/121.1 |
| 2002/0020142 | A1 * | 2/2002 | Swiszcz et al. | 52/783.1 |
| 2002/0053176 | A1 * | 5/2002 | Colson et al. | 52/506.06 |
| 2003/0154679 | A1 * | 8/2003 | Swiszcz et al. | 52/506.07 |
| 2006/0112655 | A1 * | 6/2006 | Swiszcz et al. | 52/222 |
| 2008/0283535 | A1 * | 11/2008 | Westrate et al. | 220/529 |
| 2009/0297736 | A1 * | 12/2009 | Keighley | 428/12 |

FOREIGN PATENT DOCUMENTS

| | | | |
|---|---|---|---|
| DE | 10110533 | A1 | 9/2002 |
| FR | 2586441 | A1 | 2/1987 |
| GB | 802205 | | 10/1955 |
| GB | 890370 | | 2/1959 |
| JP | 3128029 | U | 5/1991 |
| JP | 2001252483 | A | 9/2001 |
| WO | 9929979 | A1 | 6/1999 |

* cited by examiner

ACOUSTICAL GRID AND METHOD OF USE

CROSS REFERENCE TO RELATED APPLICATION

This application claims the benefit of U.S. Provisional Patent Application No. 61/665,459, filed Jun. 28, 2012, which is incorporated herein by reference in its entirety.

BACKGROUND

Acoustical panels can be embedded in or suspended from a ceiling or wall to provide sound control through reflection and/or absorption of sound waves. Sound control can be important in both small environments, such as conference rooms, and large environments, such as theatres or manufacturing facilities, for example. Appropriate sound control can diminish sound transmission between spaces to facilitate privacy and communication. Sound control can also be important in environments such as manufacturing facilities for decreasing the noise level, which can provide a safer work environment.

BRIEF SUMMARY

According to one embodiment of the invention, a method for dampening acoustical vibration within a room comprises providing a grid formed by a plurality of superimposed, non-intersecting panels having a depth and made form a flexible or deformable material such that the grid is collapsible into a generally flat collapsed position and expandable through a parallelogram movement to an expanded position in which a two-dimensional array of cells are defined by portions of the panels, each cell having an open center portion defined by the depth of the panels and the open center portion of each of the plurality of cells terminates in opening at each end of the cell, each cell having a longitudinal axis extending between the openings at each end of the cell and through the open center portion thereof. The grid can be expanded from the collapsed position to the expanded position and positioned adjacent a wall surface in a room at a selected distance above floor level so that the openings at one end of the two-dimensional array of cells are open to the wall surface and the openings at the other end of the two-dimensional array of cells are open to the room to the room to attenuate acoustical sound within the room.

According to another embodiment, the method further comprises a hanging device selected from at least one of a cable, a clamp, a clip, or a hook. The grid can further comprise a sleeve adjacent an upper perimeter thereof, and further comprise an elongated reinforcing member provided in the sleeve to prevent deformation of the grid in the expanded position. The sleeve can be integrally formed with the grid.

According to another embodiment, the flexible or deformable material comprises a textile. Further, the material forming the panels of the grid can have both light diffusion and acoustical dampening properties.

According to yet another embodiment, the method further comprises the step of removing the grid from the hanging device and returning the grid to the collapsed position for storage.

According to another embodiment, the wall surface is a ceiling within the room. In yet another embodiment, the positioning of the grid adjacent a wall surface in the room at a selected distance above floor level comprises positioning the grid so that the longitudinal axis of the plurality of cells is generally perpendicular to the wall surface.

DETAILED DESCRIPTION

Figure 1:
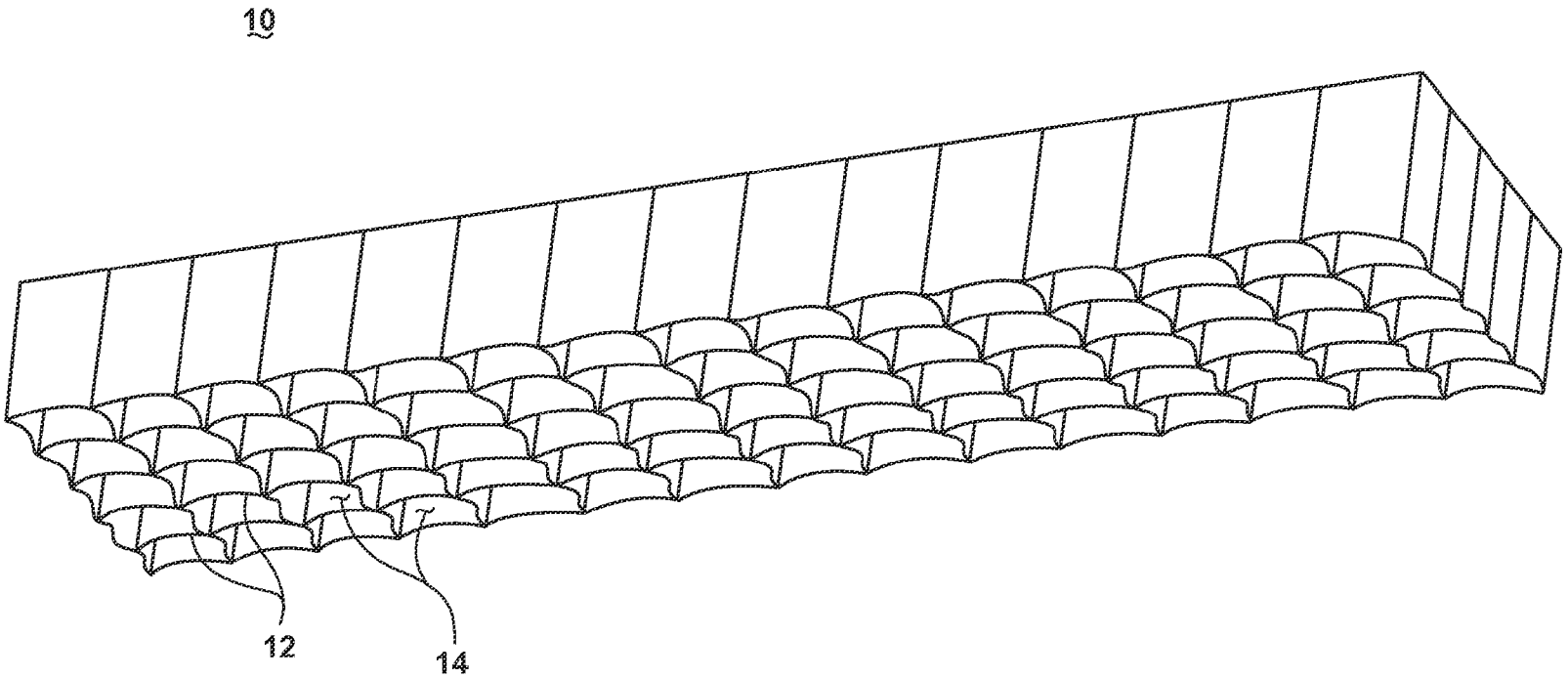
FIG. 1 illustrates a perspective view of an acoustical grid according to an embodiment of the invention.
Figure 2A:
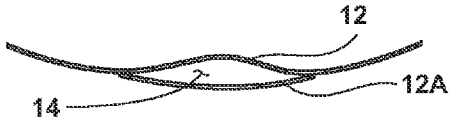
FIG. 2A-H are a schematic illustration of a method of assembling an acoustical grid according to a second embodiment of the invention.
Figure 2B:
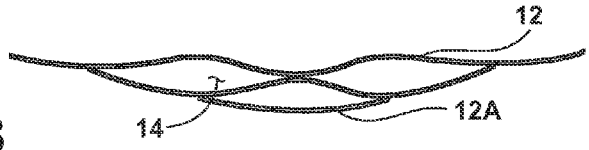
Figure 2C:
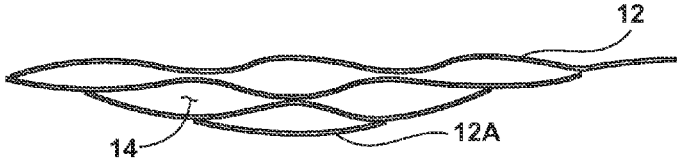
Figure 2D:
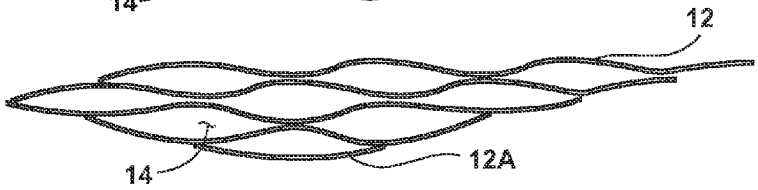
Figure 2E:
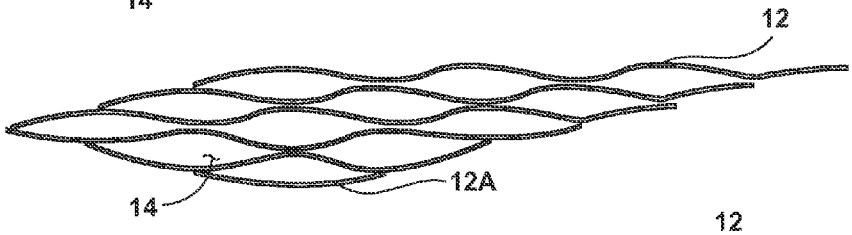
Figure 2F:
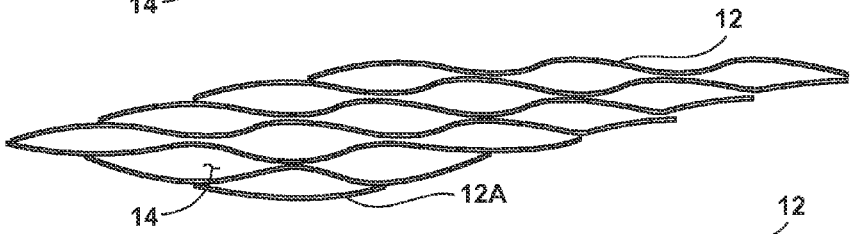
Figure 2G:
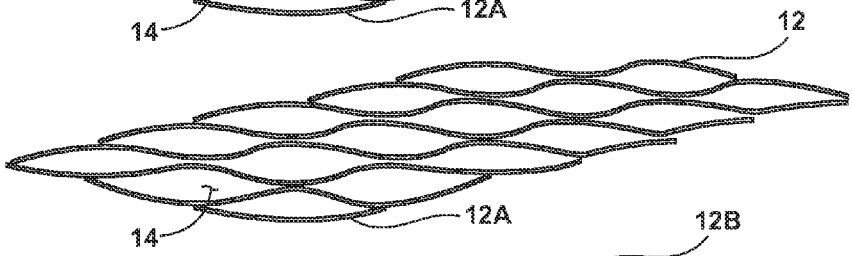
Figure 2H:
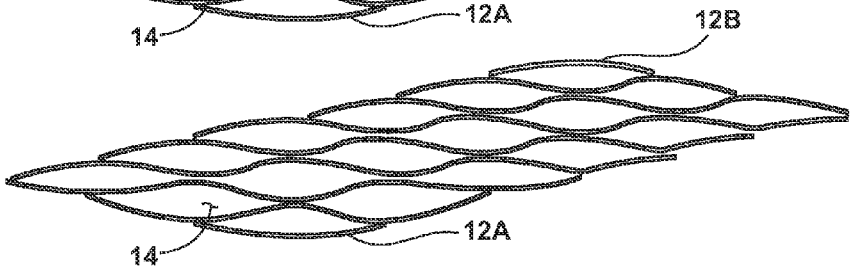

FIG. 1 illustrates an acoustical grid 10 that can be used to control sound, such as by dampening acoustical vibration, for example, within the adjacent environment, such as a room in a building structure. As used herein, controlling sound includes reflection, absorption, redirection and/or diffusion of sound waves to attenuate acoustical sound within the environment or within a portion of the environment. It is also within the scope of the invention for the acoustical grid 10 to be used to reflect, absorb, redirect and/or diffuse electromagnetic waves, such as visible light, for example.

The acoustical grid 10 can comprise a plurality of internal panels 12 defining a plurality of cells 14. The acoustical grid 10 can be made according to any of the methods for forming cellular assemblies described in U.S. Pub. No. 20080283535 to Westrate et al., filed May 15, 2007, which is hereby incorporated by reference in its entirety.

As illustrated in FIGS. 2A-H and discussed in detail in U.S. Pub. No. 20080283535 to Westrate et al., the barrier grid 10 can be formed from a plurality of panels 12. Each panel 12 is connected with adjacent panels 12 using an adhesive or weld, for example, to form cells 14. Each panel 12 is superimposed with the other panels 12 forming the barrier grid 10 and does not intersect with the other panels 12 forming the barrier grid 10.

The length and number of panels 12 and the number and spacing of connections between adjacent panels 12 can be varied to provide an acoustical grid 10 having any desired number of cells 14. All of the cells 14 can have the same dimensions, as illustrated. Alternatively, the acoustical grid 10 can have cells 14 having different dimensions. The acoustical grid 10 can have a generally rectangular shape, as illustrated, in which one pair of opposite sides is shorter than the other pair of opposite sides, or the barrier grid 10 can have a square shape in which all four sides have the same length.

Figure 3A:
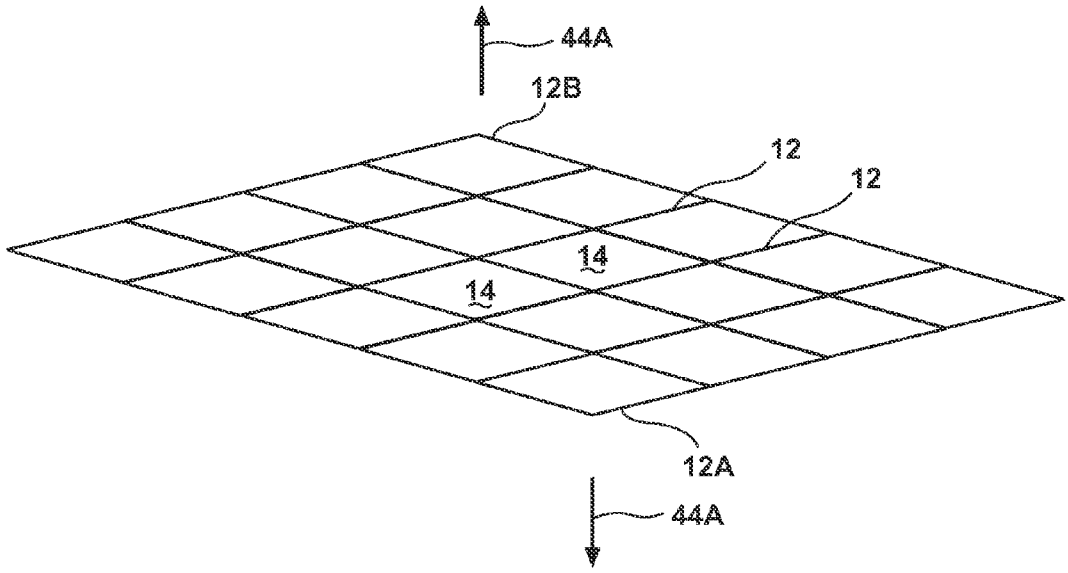
FIG. 3A is a schematic illustration of an acoustical grid in a partially collapsed condition according to a fourth embodiment of the invention.
Figure 3B:
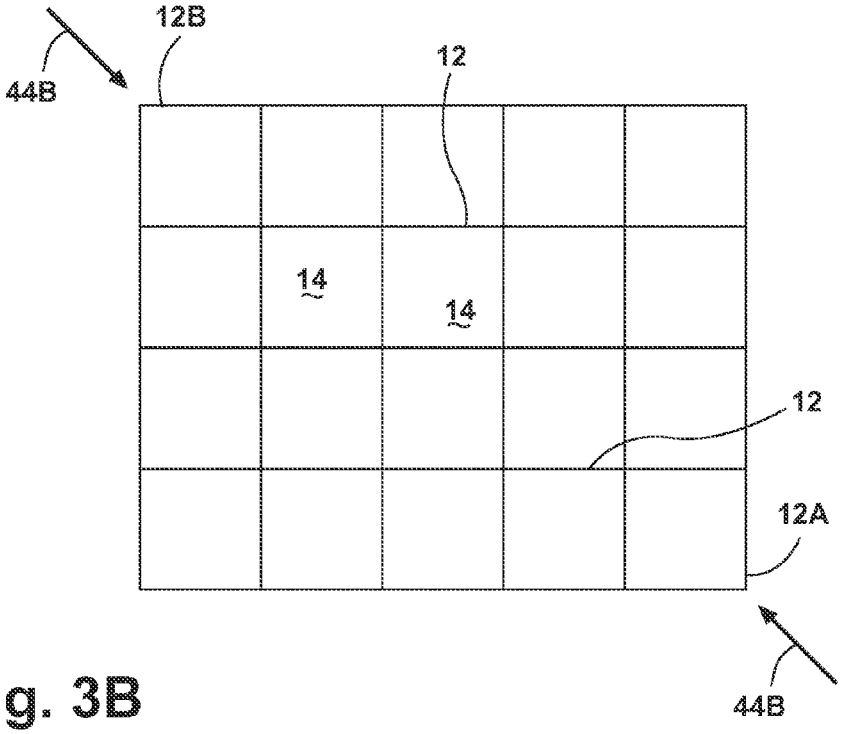
FIG. 3B is a schematic illustration of the acoustical grid of FIG. 3A in a fully expanded condition.

Referring now to FIGS. 3A-B, the stack of superimposed panels 12 forming the acoustical grid 10 can be expanded from a partially collapsed condition, illustrated schematically in FIG. 3A, by pulling a first corner 12A away from an opposite corner 12B, as illustrated by arrows 44A, to the expanded condition illustrated in FIG. 3B. As the acoustical grid 10 is expanded, the superimposed panels 12 form the cells 14 having an open center portion, such that each cell 14 has four cell walls, with each cell wall formed from a portion of a single panel 12. The acoustical grid 10 can be collapsed in a parallelogram motion to the collapsed condition illustrated in FIG. 3A, by moving corners 12A and 12B towards each other, as illustrated by arrows 44B in FIG. 3B.

The acoustical grid 10 can be made from any suitable flexible or deformable material. For example, the acoustical grid 10 can be made from woven or non-woven fabric or synthetic or natural fibers. In one example, the acoustical grid 10 can be made from a soft, flexible material, such as a fabric. As used herein, a fabric is a material produced by weaving, knitting or felting natural or synthetic textile fibers. The width of the panels 12 can be selected so as to provide an acoustical grid 10 having a desired depth when expanded.

Figure 4:
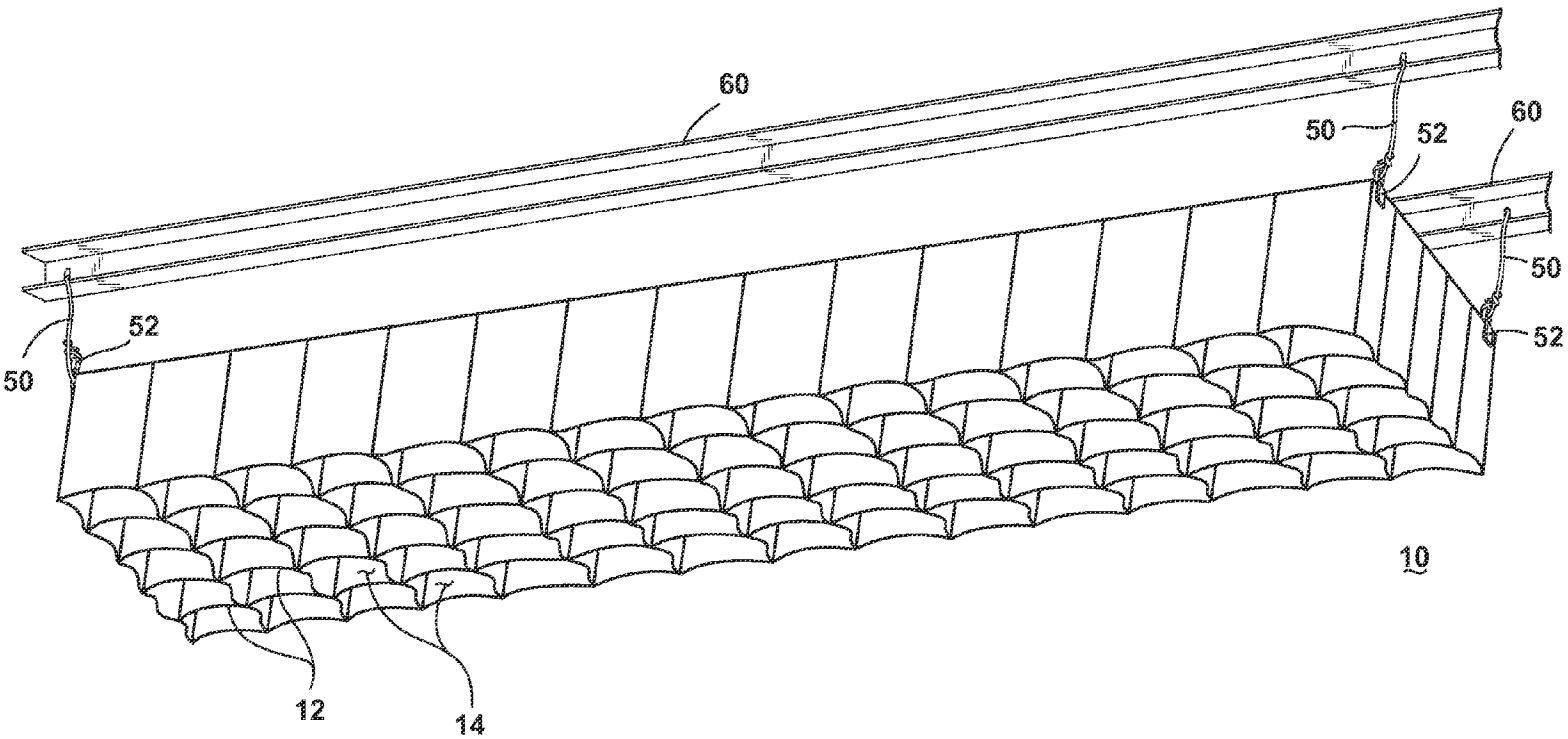
FIG. 4 illustrates a method of use of the acoustical grid of FIG. 1 according to a fifth embodiment of the invention.

Referring now to FIG. 4, in use the acoustical grid 10 can be expanded at a desired installation site and suspended above the desired area, such as suspended above the floor in a room in a building structure. In the embodiment illustrated in FIG. 4, the acoustical grid 10 can be suspended above the floor using a hanging device, which can be in the form of multiple tethers 50 that can be attached to the acoustical grid 10 using an attachment element 52, such as a clip or clamp, at a first end and to the ceiling 60 at a second end. Alternatively, the second end of the tethers 50 can be attached to a wall adjacent the desired area (not shown). The tether 50 can be made from a natural or synthetic fiber or a metal or metal alloy, for example.

In another example, panels 12 along the perimeter of the acoustical grid 10 can be provided with a plurality of grommets adjacent the corners of the acoustical grid 10. In this embodiment, the tether 50 can be provided with a hook at the first end instead of a clamp to grasp the grommet. Alternatively, the tether 50 could simply be inserted through the grommet and knotted. Similarly, the other end of the tether 50 can be attached to a wall and/or ceiling using any known mechanical or non-mechanical fastener or simply by tying the tether 50 to a suitable portion or attachment element of the wall and/or ceiling. The tether 50 can be attached to lighting or beam work already present or the walls and/or ceiling can be provided with attachment elements specifically for securing the tether 50.

The tethers 50 can be attached to the acoustical grid 10 at any desired location along the length of the perimeter of the acoustical grid 10 and/or along the length of any of the panels 12. For example, the tethers 50 can be attached to the acoustical grid 10 at or adjacent the corners, as illustrated in FIG. 4. In another example, the tethers 50 can be attached to the acoustical grid 10 at one or more locations between adjacent corners. In yet another example, the tethers 50 can be secured to portions of the panels 12 forming interior cells 14.

Multiple acoustical grids 10 can be placed adjacent one another to fill the desired space. The adjacent acoustical grids 10 can simply be placed near one another or they can be fastened together using any suitable mechanical or non-mechanical fastener, such as clips, adhesives, snaps or hook and loop tape, for example.

Figure 5:
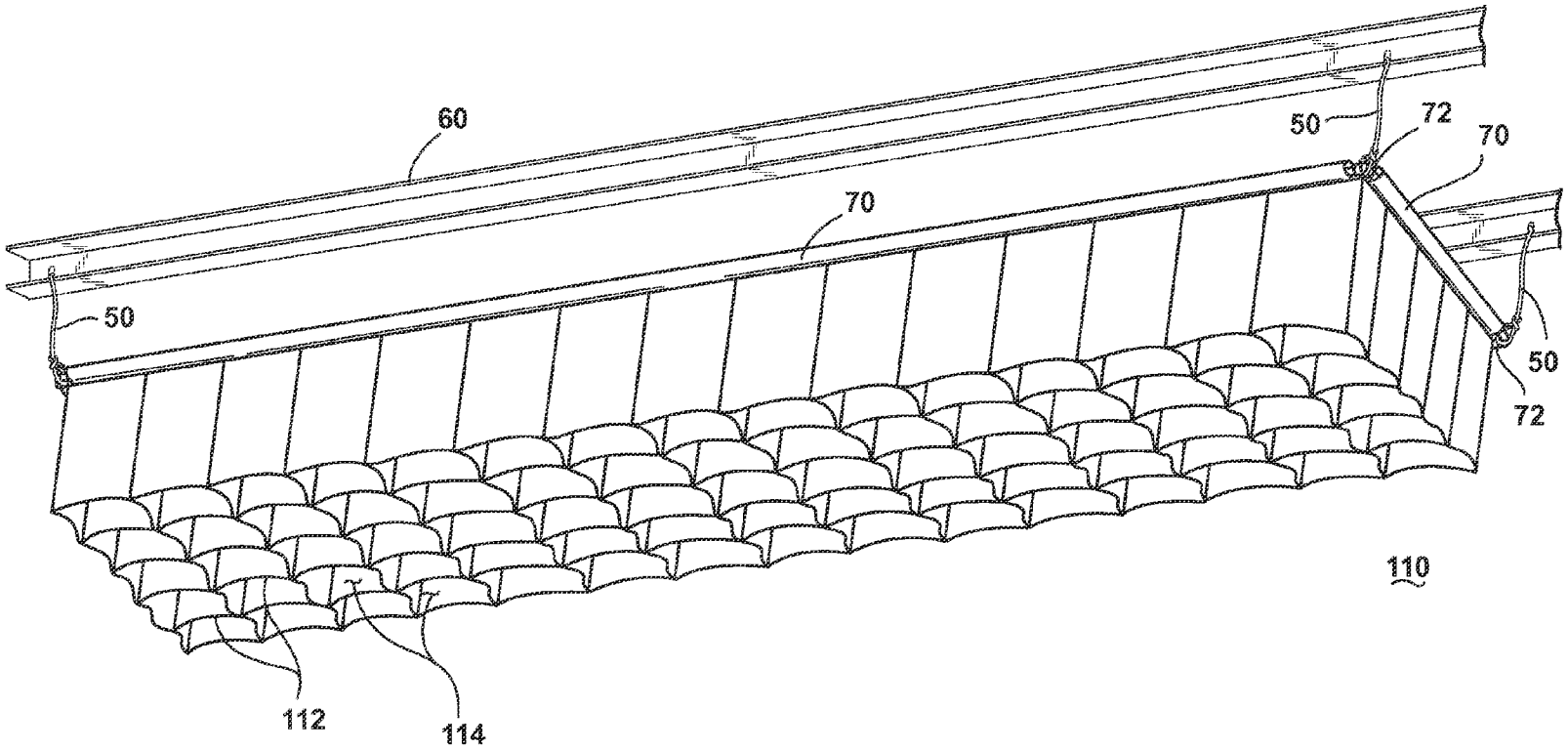
FIG. 5 illustrates a perspective view of an acoustical grid according to a fifth embodiment of the invention.

FIG. 5 illustrates an acoustical grid 110 that is similar to the acoustical grid 10 except for a sleeve 70. Therefore, elements of the acoustical grid 110 similar to that of the acoustical grid 10 are labeled with the prefix 100.

As illustrated in FIG. 5, the sleeve 70 can be formed from a piece of material folded and attached to an outer edge of the panels 12 along the perimeter of the acoustical grid 10. The sleeve 70 can be provided with a support element 72 in the form of an elongated reinforcing member, such as a conduit or rail. The support element 72 can provide structural support to the acoustical grid 110 to prevent deformation of the acoustical grid in the expanded position and can also facilitate suspending the acoustical grid 110 above the installation site. One or more tethers 50 can be attached to the support element 72 using any suitable mechanical or non-mechanical fastener such as a clamp or hook or simply by tying the tether 50.

The sleeve 70 can be provided in multiple sections around the perimeter of the acoustical grid 110, as illustrated. Alternatively, the sleeve 70 can be provided as a single channel extending around multiple sides of the acoustical grid 110. In another example, the sleeve 70 can be provided on only two of the four sides of the acoustical grid 110. The sleeve 70 can be made from an additional material that is secured along the perimeter of the acoustical grid 110 using any suitable mechanical or non-mechanical fastener such as an adhesive, weld, hook and loop tape, snaps, clips and/or stitching. Alternatively, the material forming the sleeve 70 can be integrally formed with the panels 112 along the perimeter of the acoustical grid 10.

The acoustical grids described herein are light-weight and easy to install and provide sound control to attenuate acoustical sound within a room by dampening acoustical vibration and can also provide light diffusion. The acoustical grid can be easily collapsed and folded for storage and transport, decreasing shipping and storage costs. The acoustical grids can be quickly assembled at the installation site without the use of special tools. The acoustical grids can also be easily dis-assembled and removed for storage or replacement.

The open cell structure of the acoustical grids described herein uses less material to cover a large area and can be engineered to have the dimensions required for a specific installation site. For example, the length, width and depth of each cell can be designed according to the type of acoustical sound control desired and can be based on the wave length of the acoustical vibrations present at the installation site. In addition, the overall dimensions of the acoustical grid can be designed to accommodate different size spaces and multiple acoustical grids can be used together to cover larger areas. Identical or different acoustical grids can be used in the same space to control different acoustical vibrations and or light elements at the installation site. The soft, three dimensional structure can break up the hard surfaces present at an installation site that reflect acoustical vibrations.

In addition, the flexible material can be twisted or flexed to fit into spaces having uneven surfaces and angles other than right angles. The flexibility allows the acoustical grid to be used in more spaces and can also provide an element of design aesthetic.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for dampening acoustical vibration within a room comprising:

providing a grid formed by a plurality of superimposed, non-intersecting panels having a depth and made from a flexible or deformable material such that the grid is collapsible into a generally flat collapsed position and expandable through a parallelogram movement to an expanded position in which a two-dimensional array of cells are defined by portions of the panels, each of said cells having an open center portion defined by the depth of the panels and the open center portion of each of said cells terminates in openings at a first end and a second end of each of said cells, each of said cells having a longitudinal axis extending between the openings at the first end and the second end and through the open center portion of each of said cells;

expanding the grid from the collapsed position to the expanded position; and positioning the grid adjacent a wall surface in the room at a selected distance above a floor level so that the openings at one of the first end and the second end of the two-dimensional array of cells are open to the wall surface and the openings at the other of the first end and the second end of the two-dimensional array of cells are open to the room to attenuate acoustical sound within the room;

wherein positioning the grid adjacent the wall surface in the room at the selected distance above the floor level comprises positioning the grid so that the longitudinal axis of the plurality of cells is substantially perpendicular to the wall surface.

2. The method of claim 1, further comprising installing the grid on a hanging device selected from the group consisting of a cable, a clamp, a clip and a hook.

3. The method of claim 2 wherein the grid further comprises a sleeve adjacent an upper perimeter thereof, and further comprising an elongated reinforcing member provided in the sleeve to prevent deformation of the grid in the expanded position.

4. The method of claim 3 wherein the sleeve is integrally formed with the grid.

5. The method of claim 1 wherein the flexible or deformable material comprises a textile.

6. The method of claim 1 wherein the flexible or deformable material has both light diffusion and acoustical damping properties.

7. The method of claim 2 further comprising removing the grid from the hanging device and returning the grid to the collapsed position for storage.

8. The method of claim 1 wherein the wall surface is a ceiling within the room.

* * * * *